US011302184B2

(12) United States Patent
Fukumori et al.

(10) Patent No.: US 11,302,184 B2
(45) Date of Patent: Apr. 12, 2022

(54) ANALYSIS DEVICE AND ANALYSIS METHOD

(71) Applicant: HONDA MOTOR CO., LTD., Tokyo (JP)

(72) Inventors: Minoru Fukumori, Tokyo (JP); Yoshiaki Sugimoto, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/288,565

(22) PCT Filed: Aug. 2, 2019

(86) PCT No.: PCT/JP2019/030475
§ 371 (c)(1),
(2) Date: Apr. 25, 2021

(87) PCT Pub. No.: WO2020/100353
PCT Pub. Date: May 22, 2020

(65) Prior Publication Data

US 2021/0398422 A1 Dec. 23, 2021

(30) Foreign Application Priority Data

Nov. 14, 2018 (JP) ..... JP2018-213795

(51) Int. Cl.
*G08G 1/08* (2006.01)
*G08G 1/01* (2006.01)

(52) U.S. Cl.
CPC ..... *G08G 1/08* (2013.01); *G08G 1/0104* (2013.01)

(58) Field of Classification Search
CPC ..... G08G 1/08; G08G 1/0104; G08G 1/04; G08G 1/0968
See application file for complete search history.

(56) References Cited

U.S. PATENT DOCUMENTS

2005/0093720 A1* 5/2005 Yamane ..... G08G 1/096827 340/995.13
2007/0213924 A1* 9/2007 Nagase ..... G08G 1/096811 701/414

(Continued)

FOREIGN PATENT DOCUMENTS

JP 2010176243 A 8/2010
JP 2011186872 A 9/2011

(Continued)

*Primary Examiner* — Hoi C Lau
(74) *Attorney, Agent, or Firm* — CKC & Partners CO., LLC

(57) ABSTRACT

The present invention performs analysis more appropriately on the basis of information such as location information for a plurality of moving objects. An analysis device 30 comprises: a 311 that receives changes in location information for a plurality of vehicles 50; a storage unit 32 that stores a road on which the plurality of vehicles 50 can travel, together with link information including an intersection; a link designation unit 312 that accepts a designation of the link information to be analyzed; and a control unit 313 that differentiates between respective routes of the plurality of vehicles 50 after passage through the link corresponding to the designated link information, totals the link passage times for each route, and specifies a cause of congestion on the basis of the separation between representative values for each route, said separation being based on the results of the totaling.

4 Claims, 11 Drawing Sheets

(56) References Cited

U.S. PATENT DOCUMENTS

| | | | | |
|---|---|---|---|---|
| 2008/0094250 | A1* | 4/2008 | Myr | G08G 1/04 340/909 |
| 2008/0162033 | A1* | 7/2008 | Wagner | G01C 21/367 701/533 |
| 2008/0275629 | A1* | 11/2008 | Yun | G08G 1/096838 701/118 |
| 2008/0275640 | A1* | 11/2008 | Yun | G08G 1/096775 701/533 |
| 2010/0049428 | A1* | 2/2010 | Murata | G09B 29/007 701/118 |
| 2011/0060495 | A1* | 3/2011 | Kono | G08G 1/096833 701/31.4 |
| 2011/0276257 | A1* | 11/2011 | Zaitsu | G08G 1/0104 701/117 |
| 2017/0069200 | A1* | 3/2017 | Masutani | H04L 67/42 |
| 2018/0174447 | A1 | 6/2018 | Pellolio et al. | |
| 2020/0025584 | A1* | 1/2020 | Fowe | G01C 21/3415 |
| 2020/0234570 | A1* | 7/2020 | Nishimura | G08G 1/0129 |

FOREIGN PATENT DOCUMENTS

| | | | |
|---|---|---|---|
| JP | 2011192051 | A | 9/2011 |
| JP | 2018077709 | A | 5/2018 |
| WO | 2010087382 | A2 | 8/2010 |

* cited by examiner

FIG. 5

POSITIONAL INFORMATION DATABASE

| MOVABLE BODY IDENTIFICATION INFORMATION | TIME AND DATE OF MOVEMENT | MOVEMENT HISTORICAL CHANGE INFORMATION |
|---|---|---|
| ... | ... | ... |
| | ... | ... |
| | ... | ... |
| | ⋮ | ⋮ |
| | ... | ... |
| ... | ... | ... |
| | ... | ... |
| | ... | ... |
| | ⋮ | ⋮ |
| | ... | ... |
| ⋮ | ⋮ | ⋮ |
| ... | ... | ... |
| | ... | ... |
| | ... | ... |
| | ⋮ | ⋮ |
| | ... | ... |

FIG. 7

ANALYTICAL INFORMATION DATABASE

| TIME PERIOD | LINK PASSAGE TIME (STRAIGHT-AHEAD ROUTE) | LINK PASSAGE TIME (LEFT-TURN ROUTE) | LINK PASSAGE TIME (RIGHT-TURN ROUTE) |
|---|---|---|---|
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ××× | ××× | ××× | ××× |
| ⋮ | ⋮ | ⋮ | ⋮ |
| ××× | ××× | ××× | ××× |

ANALYSIS DEVICE AND ANALYSIS METHOD

TECHNICAL FIELD

The present invention relates to an analysis device and an analysis method for conducting an analysis of movable bodies.

BACKGROUND ART

To prevent or alleviate traffic congestion on roads where automobiles and the like travel, it has been desired to analyze a traffic status. In particular, traffic statuses of a right-turn route, a left-turn route, and a straight-ahead route from an intersection change from moment to moment due to various causes, such as how much the right-turn route is congested with oncoming vehicles, whether pedestrians are present on or absent from the left-turn route, and how much a road to which the straight-ahead route leads is congested with vehicles. For this reason, it is particularly difficult to analyze a traffic status at intersections.

Patent Document 1 discloses a technique to analyze such a traffic status at an intersection. According to the technique disclosed in Patent Document 1, an onboard device of a vehicle that has passed through an intersection designated to be an analysis target generates direction-specific probe information, which includes positional information collected in a predetermined section until the vehicle has passed through the intersection and identification information of a link along which the vehicle traveled after passing through the intersection. It is possible to grasp, from the direction-specific probe information, a state of traffic flow in each of outgoing directions of the intersection. Further, it is possible to determine, from the grasped state of traffic flow, whether traffic congestion has occurred.

Patent Document 1: Japanese Unexamined Patent Application, Publication Wo. 2010-176243

DISCLOSURE OF THE INVENTION

Problems to be Solved by the Invention

However, according to the technique of Patent Document 1, even when the vehicle associated with the direction-specific probe information is decelerated not due to traffic congestion, but according to the driver's intension or due to a vehicle trouble, a determination may foe made that traffic congestion has occurred. This is because based on the assumption that the direction-specific probe information accurately reflects a traffic state, a determination on whether traffic congestion has occurred is made on the basis of the direction-specific probe information of one vehicle for each of the outgoing directions.

In view of the foregoing, it is an object of the present invention to provide an analysis device and an analysis method that are capable of conducting a more suitable analysis based on positional information of a plurality of movable bodies and other information.

Means for Solving the Problems

A first aspect of the present invention is directed to an analysis device (e.g., an analysis device 30 to be described later). The analysis device includes: a reception unit (e.g., a unit denoted by 311 to be described later) that receives changes in positional information of a plurality of movable bodies (e.g., vehicles 50 to be described later); a map information storage unit (e.g., a storage unit 32 to be described later) that stores information of roads where the plurality of movable bodies are allowed to pass, together with link information of links including intersections; a link designation unit (e.g., an analytical condition designation unit 312, to be described later) that receives designation that indicates the link information designated to be an analysis target; and a control unit (e.g., a unit denoted by 313, to be described rater) that determines routes taken by the plurality of movable bodies that have passed through the link corresponding to the designated link information, totalizing link passage times for each of the routes, and identifying a cause of traffic congestion from a disparity between representative values of the respective routes based on results of totalization.

The analysis device according to the first aspect, which conducts the analysis based on the changes in the positional information of the plurality of movable bodies, can provide further suitable analytical results, in comparison with the prior art. Further, employing the disparity between the representative values of the respective routes as an explicit criterion enables the analysis to be conducted in a simple manner.

A second aspect of the present invention is an embodiment of the first aspect. In the analysis device according to the second aspect, the representative value may be a mode value, a median value, or a mean value of the link passage times or of link passage speeds calculated based on the link passage times and a distance between both ends of the link corresponding to the link information.

According to the second aspect, the analysis can be conducted based on the mode value, the median value, and the mean value, which are easy to calculate. This feature reduces the time required for the analysis, and makes it possible to conduct the analysis substantially in real time.

A third aspect of the present invention is an embodiment of the first or second aspect. The analysis device according to the third aspect may further include a traffic control instruction unit (e.g., a traffic control instruction unit 31A to be described later) that instructs an external traffic control apparatus to switch control such that the cause of traffic congestion identified by the control unit is eliminated.

According to the third embodiment, the control by the traffic control apparatus (e.g., a traffic light) is switched, thereby facilitating elimination of the cause of traffic congestion identified by way of the analysis.

A fourth aspect of the present invention is directed to an analysis method to be performed by a computer (e.g., an analysis device 30 to be described later). The analysis method includes: a reception step including receiving changes in positional information of a plurality of movable bodies (e.g., vehicles 50 to be described later); a map information storage step including storing information of roads where the plurality of movable bodies are allowed to pass, together with link information of links including intersections; a link designation step including receiving designation that indicates the link information designated to be an analysis target; and a control step including determining routes taken by the plurality of movable bodies that have passed through the link corresponding to the designated link information, totalizing link passage times for each of the routes, and identifying a cause of traffic congestion from a disparity between representative values of the respective routes teased on results of totalization.

The method according to the fourth aspect provides the same effects as those of the first aspect.

Effects of the Invention

The present invention makes it possible to achieve a more suitable analysis based on positional information of a plurality of movable bodies and other information.

BRIEF DESCRIPTION OF THE DRAWINGS

FIG. 5 illustrates an example of a positional information database according to an embodiment of the present invention;

FIG. 7 illustrates an example of an analytical information database according to an embodiment of the present invention;

PREFERRED MODE FOR CARRYING OUT THE INVENTION

A preferred embodiment of an analysis system of the present invention will be described with reference to the drawings.

Overall Configuration of Analysis System 1

Figure 1:
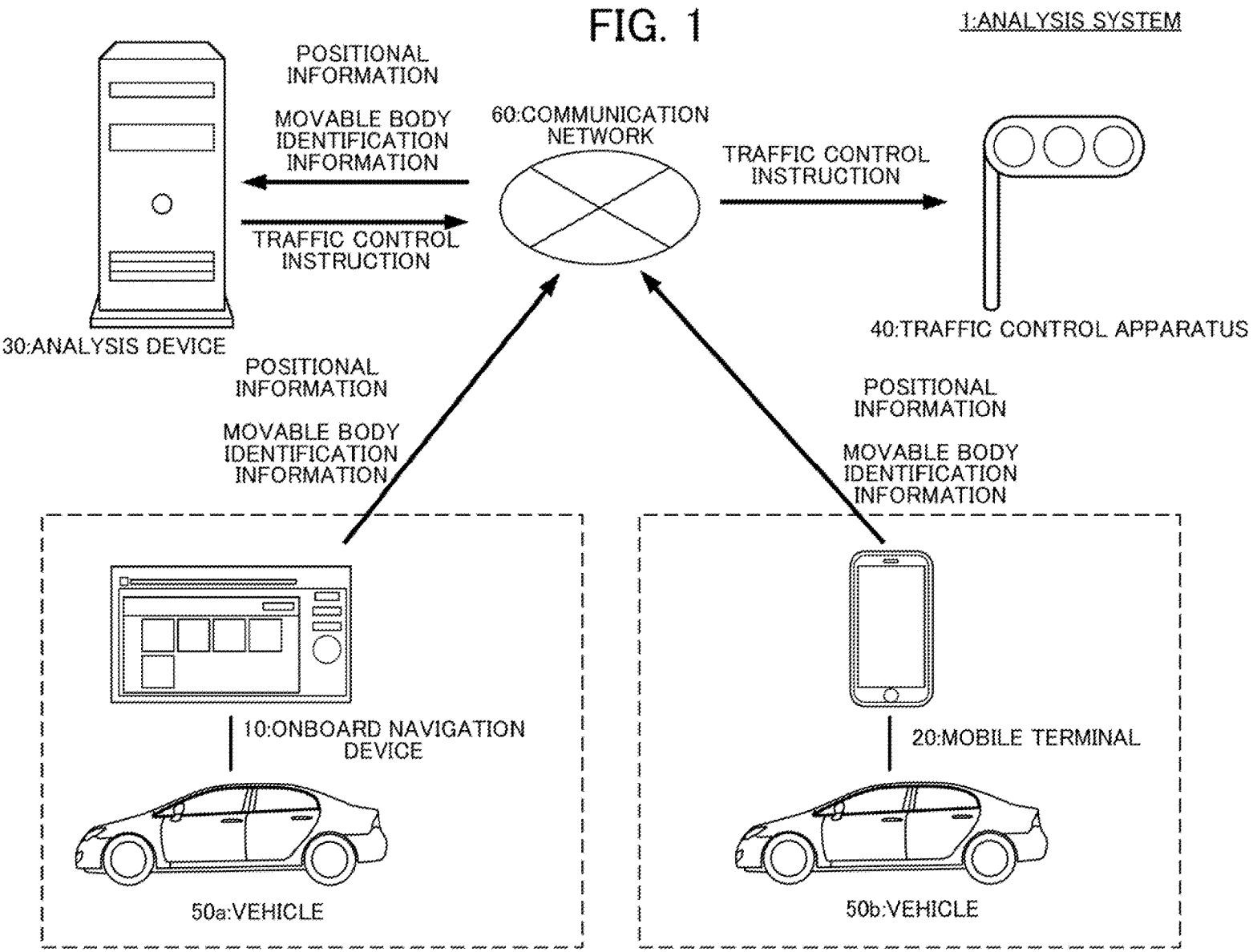
FIG. 1 is a block diagram illustrating a basic configuration of an overall analysis system as an embodiment of the present invention.

An analysis system 1 according to a preferred embodiment of the present invention will be described. FIG. 1 illustrates the overall configuration of the analysis system 1.

As illustrated in FIG. 1, the analysis system 1 includes an onboard navigation device 10, a mobile terminal 20, an analysis device 30, and a traffic control apparatus 40. These devices and terminal are connected to be able to communicate with each other via a communication network 60. It should be noted that the drawings illustrate items of information exchangeable between these devices and terminal, as mere examples. In the present embodiment, information items other than those illustrated may be exchanged.

The onboard navigation device 10 is a device that performs navigation (route guidance) for a user in a vehicle 50*a*. The onboard navigation device 10 performs route guidance from the current position to a destination, pursuant to a request of the user. The onboard navigation device 10 further has a function of measuring positional information of the onboard navigation device 10 (i.e., positional information of the vehicle 50*a*). The positional information measured by the onboard navigation device 10 is appropriately transmitted to the analysis device 30, together with movable body identification information for identifying the vehicle 50*a*. The onboard navigation device 10 can be implemented by a car navigation device installed in the vehicle 50*a*, or a portable navigation device (PNC) that is installed in the vehicle 50*a* in a simple manner and is portable/the vehicle 50*a* being an example of movable bodies. Alternatively, the onboard navigation device 10 can be implemented by other vehicle-mountable electronic devices having a predetermined application installed therein.

The mobile terminal 20 is a mobile terminal for use by a user in a vehicle 50*b*. Like the aforementioned onboard navigation device 10, the mobile terminal 20 has a function of measuring positional information of the mobile terminal 20 (i.e., positional information of the vehicle 50*b*). Like the positional information measured by the onboard navigation device 10, the positional information measured by the mobile terminal 20 is appropriately transmitted to the analysis device 30, together with movable body identification information for identifying the vehicle 50*b*. The mobile terminal 20 can be implemented by a terminal having a predetermined application installed therein, examples of which include a smartphone, a mobile phone, a tablet terminal, a notebook computer, and other portable electronic devices.

It should be noted that, although the drawings illustrate the onboard navigation device 10 and the vehicle 50*a* forming one pair and the mobile terminal 20 and the vehicle 50*b* forming another one pair, the number of pairs of the vehicles and the navigation devices or the mobile terminals is not particularly limited. In the following description, in the case of describing the vehicle 50*a* equipped with the onboard navigation device 10 and the vehicle 50*b* carrying the user having the mobile terminal 20 without distinguishing between them, the vehicles are simply denoted as the "vehicle(s) 50" without the suffix of alphabet letters.

The analysis device 30 conducts a predetermined analysis based on, for example, the positional information of the vehicles 50, the predetermined analysis constituting processing unique to the present embodiment. The analysis device 30 can be implemented by, for example, incorporating an application for realizing the present embodiment into a server device or a personal computer.

Specifically, the analysis device 30 acquires the positional information of the vehicles 50 from the onboard navigation device 10 and the mobile terminal 20. Based on the acquired positional information of the vehicles 50, the analysis device 30 builds a positional information database in which changes in the positional information of the vehicles 50 are stored. Further, the analysis device 30 stores, as map information, information about roads where the vehicles 50 can pass, together with link information about links including intersections. Furthermore, the analysis device 30 receives an analytical condition, which a user of analytical information inputs in order to obtain the analytical information satisfying the user's desired condition. The analytical condition includes/for example, designation indicating link information corresponding to an intersection designated to be an analysis target.

The analysis device 30 conducts an analysis in accordance with the received analytical condition, based on the information stored in the positional information database and the map information. Specifically/the analysis device 30 determines a route that each of the plurality of vehicles 50 has taken after passing through a link corresponding to the link information designated by the analytical condition. For example, the analysis device 30 determines whether each vehicle 50 has taken a straight-ahead route, a left-turn route, or a right-turn route at the intersection corresponding to the link information. The analysis device 30 then totalizes link passage times for each of the routes, and identifies a cause of traffic congestion from a disparity between representative values of the respective routes based on results of the totalization. In this way, the analysis device 30 can clarify which of the right-turn route, the left-turn route, or the straight-ahead route is the cause of traffic congestion.

As can be seen, the analysis device 30 conducts the analysis based on changes in the positional information of the plurality of vehicles 50, thereby providing further suitable analytical results, in comparison with the known art. Further, employing the disparity between the representative values of the respective routes as an explicit criterion enables the analysis to be conducted in a simple manner.

The analysis device 30 may be configured to instruct, based on the analytical results, the traffic control apparatus 40 to switch traffic control such that the Identified cause of traffic congestion is eliminated. In this manner, elimination of the cause of traffic congestion identified through the analysis can be facilitated. Further, the analysis device 30 may be configured to show the analytical results to the user. Thus, the user can obtain analytical information that, satisfies the desired analytical condition that the user has inputted.

The user of the analysis device 30 may be, for example, a road manager, an administrator of a retail facility (e.g., a shopping mall) near a road, or a consultant providing consulting service to the road manager, the administrator, etc. That is, the analysis device 30 is useable by various users in various applications.

The traffic control apparatus 40 performs traffic control with respect to the vehicles 50 travelling on roads and pedestrians crossing a pedestrian crossing. The traffic control apparatus 40 is typically implemented by a traffic light. The traffic control apparatus 40 performs, by itself, the traffic control with respect to the vehicles 50 and the pedestrians by switching its signal light between an on-state and an off-state and changing a blinking state of the signal light, or by emitting a predetermined sound. Further, the traffic control apparatus 40 can switch the signal light between the on-state and the off-state or changing the blinking state of the signal light, based on a traffic control instruction from the analysis device 30. This feature facilitates elimination of the cause of traffic congestion identified by way of the analysis conducted by the analysis device 30.

The vehicles 50 are movable bodies in which the user of the onboard navigation device 10 and the user of the mobile terminal 20 ride. The vehicles 50 are implemented by four-wheeled vehicles, motorcycles, bicycles, etc.

The communication network 60 is implemented by a network such as the Internet, a mobile phone network, or a combination thereof. The network may include a local area network (LAN) as a par thereof.

Functional Blocks of Onboard Navigation Device 10

Next, functional blocks included in the onboard navigation device 10 will be described with reference to the block diagram of FIG. 2. The onboard navigation device 10 is supplied with power from the vehicle 50*a*, and is automatically actuated when the user in the vehicle 50*a* turns on an ignition switch (i.e., starts an engine) of the vehicle 50*a*. The onboard navigation device 10 remains in operation until the user in the vehicle 50*a* turns off the ignition switch (i.e., stops the engine) of the vehicle 50*a*.

Figure 2:
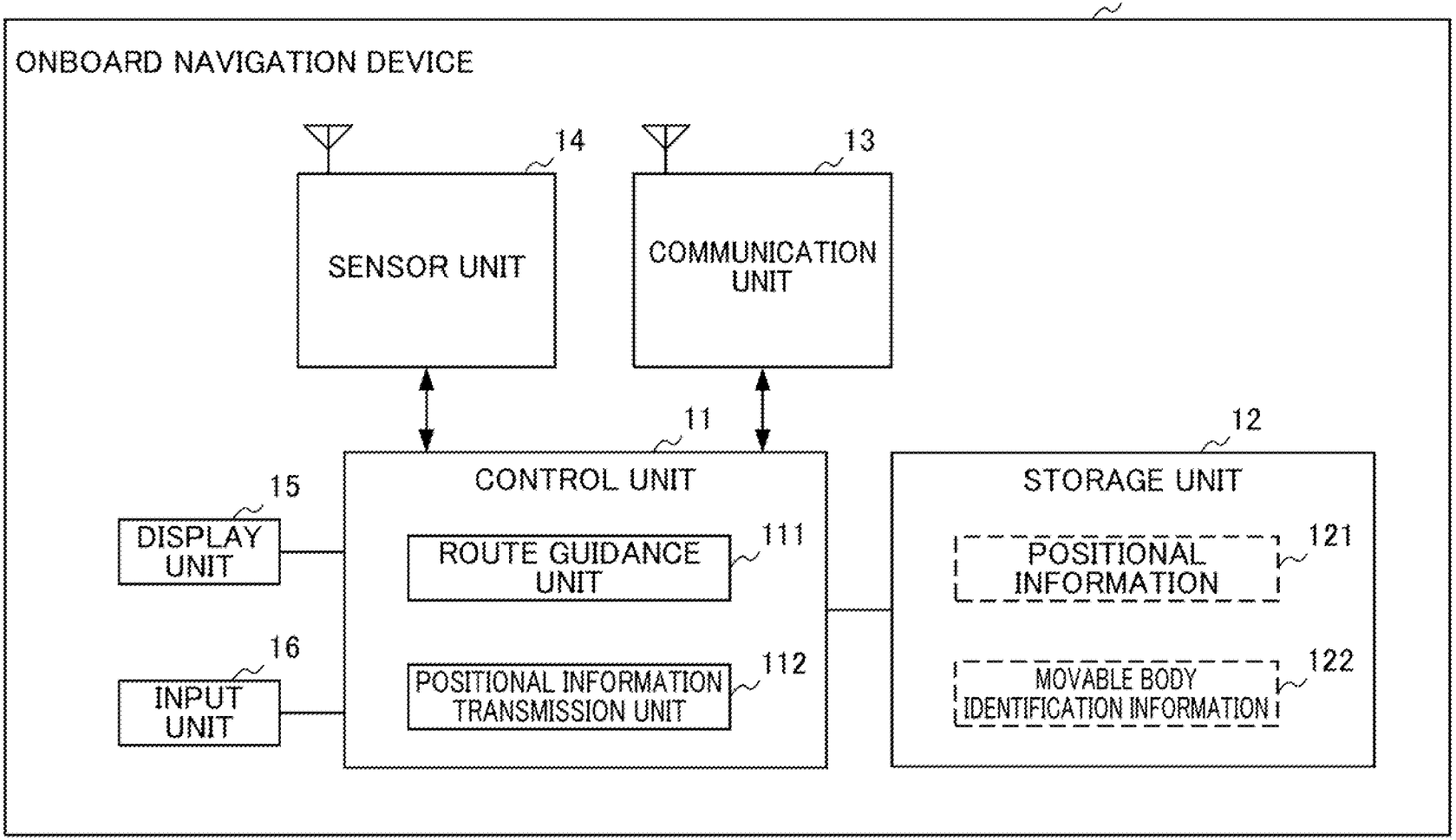
FIG. 2 is a functional block diagram illustrating a functional configuration of an onboard navigation device according to an embodiment of the present invention.

As illustrated in FIG. 2, the onboard navigation device 10 includes a control unit 11, a storage unit 12, a communication unit 13, a sensor unit 14, a display unit 15, and an input unit 16.

The control unit 11 is configured by an arithmetic processing device, such as a microprocessor, and controls the units forming the onboard navigation device 10. The details of the control unit 11 will be described later.

The storage unit 12 is configured by, for example, a semiconductor memory, and stores programs, such as a control program called firmware or an operating system, a program for route guidance processing, and a program for transmitting the positional information to the analysis device 30, and further, various types of information, such as the map information. FIG. 2 illustrates, as items of information stored in the storage unit 12, the positional information 121 and the movable foody identification information 122, which are particularly related to transmission processing of the positional information.

The positional information 121 is of the onboard navigation device 10 (i.e., the vehicle 50*a*) and is measured by the sensor unit 14 to be described later. The positional information 121 includes not only information indicating the measured position, but also the time when the position was measured. The movable body identification information 122 serves for identifying the onboard navigation device 10. It is possible to employ, for example, a serial number uniquely assigned to the onboard navigation device 10, as the movable body identification information 122. Alternatively, it is possible to employ a telephone number assigned to a subscriber identity module (SIM) inserted in the communication unit 13 for the connection with the communication network 60 implemented by a network such as a mobile phone network, as the movable body identification information 122. In addition, a vehicle identification number (VIN) uniquely assigned to the vehicle 50*a* or the number on the license plate can be employed as the movable body identification information 122.

The storage unit 12 may have stored these various items of information in advance. Alternatively, the items of information may be downloaded as necessary from, for example, a server device (not illustrated) connected to the communication network 60. The information may be corrected as appropriate, in response to, for example, an input by the user.

The communication unit 13 has, for example, a digital signal processor (DSP) and adheres to a standard, such as 3rd Generation (3G), Long Term Evolution (LTE), 4th Generation (4G), or Wi-Fi®. The communication unit 13 establishes wireless communication with other devices (e.g., the analysis device 30) via the communication network 60. For example, the communication unit 13 is used when a positional information transmission unit 112 (to be described later) transmits the positional information 121 and the movable body identification information 122 stored in the storage unit 12 to the analysis device 30. However, data exchangeable between the communication unit 13 and other devices are not particularly restricted. Information other than the positional information 121 and the movable body identification information 122 may be exchanged.

The sensor unit 14 is configured by, for example, a global positioning system (GPS) sensor, a gyro-sensor, and an acceleration sensor. The sensor unit 14 functions as a position detector for detecting the positional information, receives a GPS satellite signal using the GPS sensor, and measures the positional information (latitude and longitude) of the onboard navigation device 10. As mentioned earlier, the sensor unit 14 measures the position at predetermined time intervals (e.g., at 3-second intervals). The measured positional information is stored as the positional information 121 in the storge unit 12.

The sensor unit 14 can increase measurement accuracy of the positional information of the onboard navigation device 10, baaed on an angular velocity and an acceleration measured by the gyro-sensor and the acceleration sensor. Further, in the event that the GPS communication is difficult or unavailable, the sensor unit 14 can use assisted global positioning system (AGPS) communication to calculate the positional information of the onboard navigation device 10 on the basis of base station information acquired by the communication unit 13.

The display unit 15 is configured by a display device, such as a liquid crystal display or an organic electroluminescence panel. The display unit 15 displays images in response to an instruction received from the control unit 11. Examples of information displayable by the display unit 15 include the current position of the onboard navigation device 10, map information related to the vicinity of the current position of the onboard navigation device 10 and read from the map information, a destination set by the user, meeting information notified by another onboard navigation device 10, route information, and various user interfaces.

The input unit 10 is configured by an input device (not illustrated) such as physical switches called a numerical keypad or a touch panel overlaid on a display screen of the display unit 15. Signals based on operations inputted through the input unit 16, such as user's pressing the numerical keypad and user's touching the touch panel, are outputted to the control unit 11, whereby the operations including the user's selection operation and scaling up and down of a map can be realized.

Additionally, a speaker and a microphone can also be provided although they are not illustrated. The speaker provides an audio output to a driver. The microphone collects sounds, such as the driver's voice. Thus, information can be outputted by voice through the speaker, and the driver's various selections and instructions that are voice-inputted through the microphone can be inputted to the control unit 11 using a speech recognition technology.

Next, the control unit 11 will be described in detail. The control unit 11 is configured by a microprocessor having, for example, a central processing unit (CPU), a random access memory (RAM), a read only memory (ROM), and an input/output (I/O). The CPU reads programs from the ROM or the storage unit 12, and executes the programs. When executing the programs, the CPU reads information from the PAM, the ROM, and the storage unit 12, writes information into the RAM and the storage unit 12, and exchanges signals with the communication unit 13, the sensor unit 14, the display unit 15, and the input unit 16. The hardware and the software (programs) cooperate with each other in this way, thereby performing the processing of the present embodiment.

The control unit 11 includes a route guidance unit 111 and the positional information transmission unit 112, as functional blocks.

The route guidance unit 111 is a component that performs route guidance processing for guiding the user to a destination, such as a facility inputted or selected by the user. The route guidance processing for guiding the user to the destination is equivalent to route guidance processing performed by a generally-used car navigation system. Specifically, the route guidance unit 111 creates a map to the destination, based on the map information (not illustrated) stored in the storage unit 12, and superimposes the current position of the onboard navigation device 10 measured by the sensor unit 14, the location of the destination, and a route to the destination on the created map. The route guidance unit 111 causes the display unit 15 to display the map with these items superimposed thereon, thereby performing the route guidance. In this case, the speaker (not illustrated) may additionally output a voice for route guidance. Further information about a traffic status of roads and weather information may be acquired through communication by the communication unit 13, and may be used in the route guidance processing. Since the route guidance processing for guiding the user to the destination is veil known to those skilled in the art, a further detailed description is omitted herein. Since the map information for performing the route guidance processing is also well known to those skilled in the art, a further detailed description and illustration are omitted herein.

The positional information transmission unit 112 is a component that transmits, via wireless communication using the communication unit 13, the positional information 121 and the movable body identification information 122 stored in the storage unit 12 to the analysis device 30. The positional information transmission unit 112 cyclically transmits the positional information 121 and the movable body identification information 122 to the analysis device 30 during a period starting from a moment when the user in the vehicle 50*a* turns on the ignition switch (i.e., starts the engine) of the vehicle 50*a* and the onboard navigation device 10 is automatically actuated, and ending at a moment when the user in the vehicle 50*a* turns off the ignition switch (i.e., stops the engine) of the vehicle 50*a*. For example, every time the sensor unit 14 conducts the position measurement at predetermined time intervals (e.g., at 3-second intervals), the positional information transmission unit 112 transmits the information in real time. Alternatively, instead of the real-time transmission to the analysis device 30, the positional information transmission unit 112 may transmit a set of several items of information (e.g., items of the positional information 121 and items of the movable body identification information 122 that have beer, updated at 3-second intervals in three minutes) at once. In ether words, the positional information transmission unit 112 may perform the so-called burst transmission. A length of the predetermined intervals and whether real-time transmission or the burst transmission is to be performed can be determined as needed in accordance with environment to which the present embodiment is applied.

By way of the real-time transmission or the burst transmission, the positional information transmission unit 112 transmits the positional information 121 measured by the sensor unit 14 and serving for identifying a travelling route of the vehicle 50*a* and the movable body identification information 122 to the analysis device 30.

In this case, a position defined by the positional information 121 measured immediately after the turning-on of the ignition switch (the start of the engine) and the automatic actuation of the onboard navigation device 10 can be transmitted as an initial position of the vehicle, i.e., a departure position, to the analysis device 30. Further, a position defined by the positional information 121 measured immediately before the turning-off of the ignition switch (the stop of the engine) can be transmitted as a latest position of the vehicle, i.e., a parking position, to the analysis device 30.

In this case, the positional information 121 may be transmitted to the analysis device 30 after addition of startup information indicating that the positional information 121 is indicative of the departure position or stop information indicating that the positional Information 121 is indicative of the parking information. For example, it is suitable to transmit the information while a flag indicating that the information associated therewith is the startup information is set to 1. It is also suitable to transmit the information while a flag indicating that the information associated therewith is the stop information is set to 1. Note that the positional information 121 measured immediately before the turning-off of the ignition switch (i.e., the parking information) may be transmitted when the ignition switch is turned on (i.e., the engine is started) and the onboard navigation device 10 is re-actuated.

Even in the case of performing the burst transmission, if the route guidance unit 111 determines that the vehicle 50*a* has arrived at a destination (e.g., a facility), the positional information transmission unit 112 suitably switches to the real-time transmission. In this way, it is possible to avoid a situation in which following the arrival at the facility, the ignition switch is turned off (i.e., the engine is stopped) before the positional information 121 as the parking information is transmitted, resulting in that the positional information 121 of the destination such as the facility is prevented from being transmitted to the analysis device 30.

Functional Blocks of Mobile Terminal 20

Next, functional blocks included in the mobile terminal 20 will be described with reference to the block diagram of FIG. 3. The onboard navigation device 10 described above is supplied with power from the vehicle 50*a*, On the other hand, the mobile terminal 20 is supplied with power from a battery (not illustrated) equipped to the mobile terminal 20 itself. However, to charge the battery, the mobile terminal 20 may be supplied with power from, for example, a cigarette lighter socket of the vehicle 50*b*.

Figure 3:
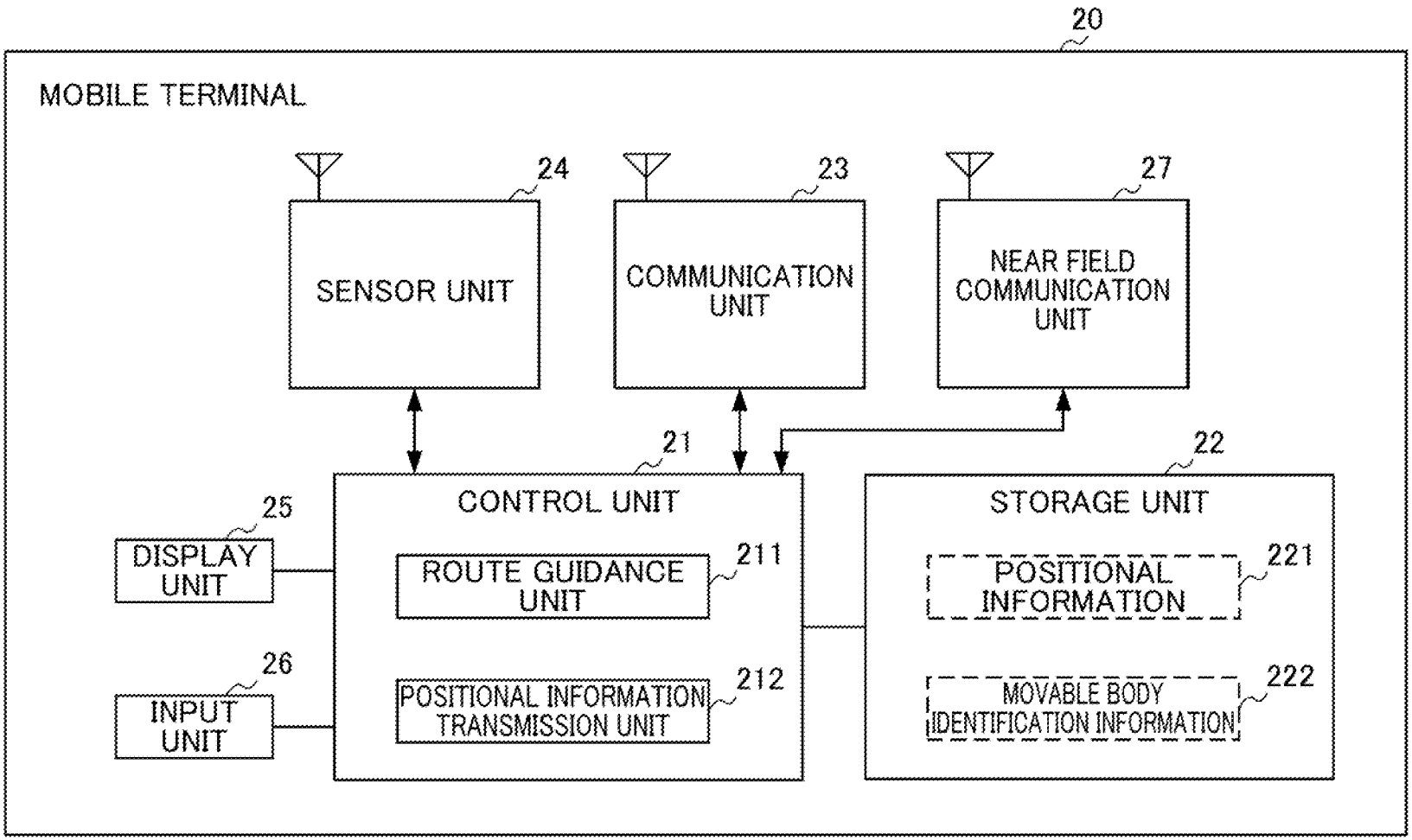
FIG. 3 is a functional block diagram illustrating a functional configuration of a mobile terminal according to an embodiment of the present invention.

As illustrated in FIG. 3, the mobile terminal 20 includes a control unit 21, a storage unit 22, a communication unit 23, a sensor unit 24, a display unit 25, an input unit 26, and a near field communication unit 27. Here, each of the control unit 21, the storage unit 22, the communication unit 23, the sensor unit 24, the display unit 25, and the input unit 26 is equivalent in function to the functional block with the same name included in the onboard navigation device 10 described above. That is, the above description of the onboard navigation device 10, in which the term "onboard navigation device 10" is replaced with the "mobile terminal 20", serves as a description of the functional blocks of the mobile terminal 20. Therefore, a redundant description will be omitted.

On the other hand, the near field communication unit 27 included in the mobile terminal 20 constitutes a difference between the mobile terminal 20 and the onboard navigation device 10. This difference will be described below. The near field communication unit 27 is a component configured to perform non-contact near field communication adhering to a standard, such as Near Field Communication (NFC) or Bluetooth®, or to perform wired near field communication via a universal serial bus (USB) cable or the like. On the other hand, the vehicle 50*b* includes a near field communication unit for communicating with the near field communication unit 27. For example, the near field communication unit is provided to an electronic control unit (ECU) of the vehicle 50*b*. The near field communication between the mobile terminal 20 and the ECU is possible when the mobile terminal 20 is present in the vehicle 50*b*. In this case, positional information measured by the sensor unit 24 of the mobile terminal 20 corresponds to positional information of the vehicle 50*b*.

While the near field communication with the ECU is possible via the near field communication unit 27, the mobile terminal 20 maintains a positional information transmission unit 212 in operation. Just like the positional information transmission unit 112 of the onboard navigation device 10, the positional information transmission unit 212 in operation transmits positional information 221 measured by the sensor unit 24 and serving for identifying a travelling route of the vehicle 50*b* and movable body identification information 222 to the analysis device 30.

For example, when the user having the mobile terminal 20 gets into the vehicle 50*b* and turns on a start switch of the vehicle 50*b*, such as the ignition switch, connection (pairing) between the vehicle 50*b* and the mobile terminal 20 is established, and the positional information 221 measured by the mobile terminal 20 and movable body identification information 222 are transmitted from the mobile terminal 20 to the information analysis device 30. In this case, a position defined by the positional information 221 measured immediately after the pairing of the vehicle 50*b* with the mobile terminal 20 can be transmitted as an initial position of the vehicle, i.e., a departure position, to the analysis device 30.

When the start switch of the vehicle 50*b*, such as the ignition switch, is turned off, the vehicle 50*b* and the mobile terminal 20 become unpaired. In this case, a position defined by the positional information 221 measured immediately before the vehicle 50*b* and the mobile terminal 20 become unpaired can be transmitted as a latest position of the vehicle, i.e., a parking position, to the analysis device 30. Just like the positional information transmission unit 112, the positional information transmission unit 212 may perform real-time transmission or burst transmission, may switch from the burst transmission to the real-time transmission when it is determined that the vehicle has arrived at the parking position, may add startup information indicating the departure position or stop information indicating the parking position, and may transmit the parking position at the time of re-actuation.

In a case where the vehicle 50*b* has a function of measuring positional information, a configuration may be adopted in which instead of the positional information measured by the sensor unit 24, the positional information measured by the vehicle 50*b* is transmitted as the positional information 121 to the analysis device 30. In this case, the sensor unit 24 may be omitted from the mobile terminal 20.

Functional Blocks of Analysis Device 30

Next, functional blocks included in the analysis device 30 will be described with reference to the block diagram of FIG. 4.

Figure 4:
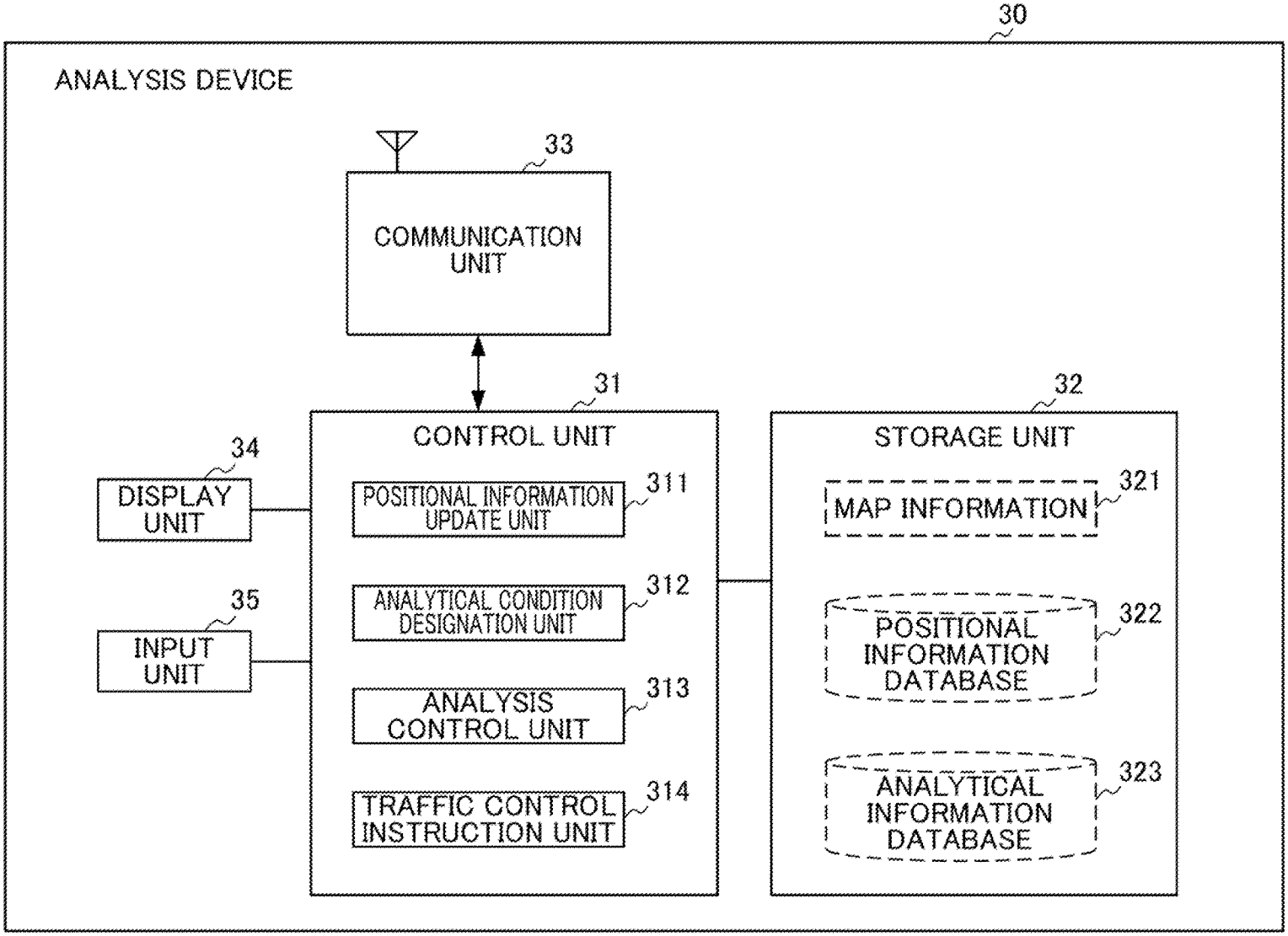
FIG. 4 is a functional block diagram illustrating a functional configuration of an analysis device according to an embodiment of the present invention.

As illustrated in FIG. 4, the analysis device 30 includes a control unit 31, a storage unit 32, a communication unit 33, a display unit 34, and an input unit 35.

The control unit 31 is configured by an arithmetic processing device, such as a microprocessor, and controls the units forming the analysis device 30. The details of the control unit 31 will be described later.

The storage unit 32 is configured by, for example, a semiconductor memory, and stores programs, such as a control program called firmware or an operating system, and a program for Information analysis processing, and further, various items of information, such as map information. FIG. A illustrates, as items of information stored in the storage unit 32, the map information 321 and a positional information database 322 that are related to analysis processing of positional information.

The map information 321 includes, for example, information related to features such as roads and facilities, road information, facilities' positional Information, and parking information. The map information 321 further includes, for example, road network data including displayable map data for displaying backgrounds of roads and road maps; positional information of nodes (e.g., intersections, bends, ends, etc. of roads) and classification information thereof; positional information of links as routes between the nodes and classification information thereof; and link cost data related to cost information (e.g., distances, required times, etc.) of all the links. That is, the map information 321 includes information of roads where the vehicles 50 can pass, and the link information of the links including the intersections.

As the road information, the so-called read map information is saved which includes the locations and shapes of roads, classification of roads, and locations of traffic lights, etc. As the facilities' positional information, the positional information of each facility is saved in the form of longitudinal and latitudinal information. The facilities' positional information may further include supplementary information such as facility identification information (facility ID), the name, the classification (and/or category) of the facility, the telephone number, the address, the business hours, the menu in the case of the facility being a restaurant or a bar, and information related to products and services. As the parking information, the positional information of parking areas is saved in the form of longitudinal and latitudinal information. In the case of the parking area belonging to a facility, the parking information is saved while the facility and the parking area are associated with each other.

The map information 321 may have been stored in the storage unit 32 in advance, or nay be downloaded as necessary from, for example, a server device (not illustrated) connected to the communication network 60. Further, the map information 321 may be corrected as appropriate, in response to, for example, an input by the user.

The positional information database 322 is a database built based on the positional information 121, 221, and the movable body identification information 122, 222 received from the onboard navigation device 10 and the mobile terminal 20. The positional information database 322 is built by a positional information update unit 311 to be described later. The details of the positional information database 322 will be described later along with a description of the positional information update unit 311. In the following description, in the case of describing the positional information 121 and the positional information 221 without distinguishing between them, they are denoted as the "positional information" without the reference numerals. Likewise, in the case of describing the movable body identification information 122 and the movable body identification information 222 without distinguishing between them, they are denoted as the "movable body identification information" without the reference numerals.

The communication unit 33 has, for example, a DSP, and adheres to a communication standard, such as 3G, LTE, 4G, or Wi-Fi®. The communication unit 33 establishes wireless communication with other devices via the communication network 60. For example, the communication unit 33 is used for reception of the positional information and the movable body identification information respectively transmitted from the onboard navigation device 10 and the mobile terminal 20. However, data exchangeable between the communication unit 33 and other devices are not particularly restricted. Information other than the foregoing information may be exchanged.

The display unit 34 is configured by a display device, such as a liquid crystal display or an organic electroluminescence panel. The display unit 34 displays images in response to an instruction received from the control unit 31. Examples of information display able by the display unit 34 include analytical results provided by an analysis control unit 313 to be described later, various items of information stored in the storage unit 32, and various user interfaces.

The input unit 35 is configured by, for example, an input interface (not illustrated) such as a keyboard or a mouse. Signals based on operations inputted through the input unit 35, such as user's pressing the keyboard and user's moving the mouse, are outputted to the control unit 31, whereby the user's selection operation and input of an analytical condition can be realized.

Next, the control unit 31 will be described in detail. The control unit 31 is configured by a microprocessor having, for example, a CPU, a RAM, a ROM, and an I/O. The CPU reads programs from the ROM or the storage unit 32, and executes the programs. When executing the programs, the CPU reads information from the PAM, the ROM, and the storage unit 32, writes information into the RAM and the storage unit 32, and exchanges signals with the communication unit 33, the display unit 34, and the input unit 35. The hardware and the software (programs) cooperate with each other in this way, thereby performing the processing of the present embodiment.

The control unit 31 includes the positional information update unit 311, an analytical condition designation unit 312, the analysis control unit 313, and a traffic control instruction unit 314, as functional blocks.

The positional information update unit 311 is a component that builds and appropriately updates the positional information database 322. With reference to FIG. 5, a data structure example of the positional information database 322 will be described.

As illustrated in FIG. 5, the positional information database 322 includes "movable body identification information" received from each of the onboard navigation device 10 and the mobile terminal 20. Further, the positional information database 322 includes "time and date of movement" and "movement historical change information" that the positional information update unit 311 specifies based on the "positional information" received from each of the onboard navigation device 10 and mobile terminal 20. The positional information update unit 311 stores each of the information items in an associated field of the positional information database 322, thereby building and updating the positional information database 322.

As described earlier, the "movable body identification information" in the positional information database 322 serves for identifying the onboard navigation device IQ and the mobile terminal 20 from which the positional information is transmitted. That is, the "movable body identification information" serves for identifying the vehicle 50 associated with the onboard navigation device 10 and the vehicle 50 associated with the mobile terminal 20.

The "time and date of movement" in the positional information database 322 constitute information indicating date and time when the vehicle 50 associated with the movable body identification information moved. In the present embodiment, for example, a movement from start to end of transmission of the positional information from the onboard navigation device 10 or the mobile terminal 20 is regarded as one movement. The date and tires corresponding to the one movement are stored as the time and date of movement in the positional information database 322.

The "movement historical change information" in the positional information database 322 indicates a movement historical change that is identified based on all the items of the positional information changing in a temporally discrete fashion and received during one movement. The positional information update unit 311 joins the changes appearing in a temporally discrete fashion in the positional information, along over the passage of measurement time, thereby identifying the movement historical change of the vehicle 50. In other words, the movement historical change information indicates a route which the vehicle 50 took and a speed at which the vehicle 50 moved. If the accuracy of the positional information is low in the environment where the present embodiment is implemented, the positional information update unit 311 may perform map matching to check the map information 321 and the positional information against each other, thereby identifying the route where the vehicle moved. However, if the accuracy of the positional information is high, the positional information update unit 311 does not necessarily have to perform the map matching.

Every time the onboard navigation device 10 or the mobile terminal 20 ends the previously started transmission of the positional information and the movable body identification information, the positional information update unit 311 stores the aforementioned items of information in blank fields, based on the received positional information and the received movable body identification information. In this way, the positional information update unit 311 updates the positional information database 322. The positional information database 322 may be corrected as appropriate. In response to, for example, an input by the user of the analysis device 30.

The analytical condition designation unit 312 is a component that receives the analytical condition. As described earlier, the user inputs the analytical condition in order to obtain desired analytical information. The analytical condition designation unit 312 generates a user interface for receiving the user's input of the analytical condition, and causes the display unit 34 implemented by a display device to display the generated user interface. With reference to the user interface, the user inputs the analytical condition using the input unit 35 implemented by an input interface such as the keyboard or the mouse.

Figure 6:
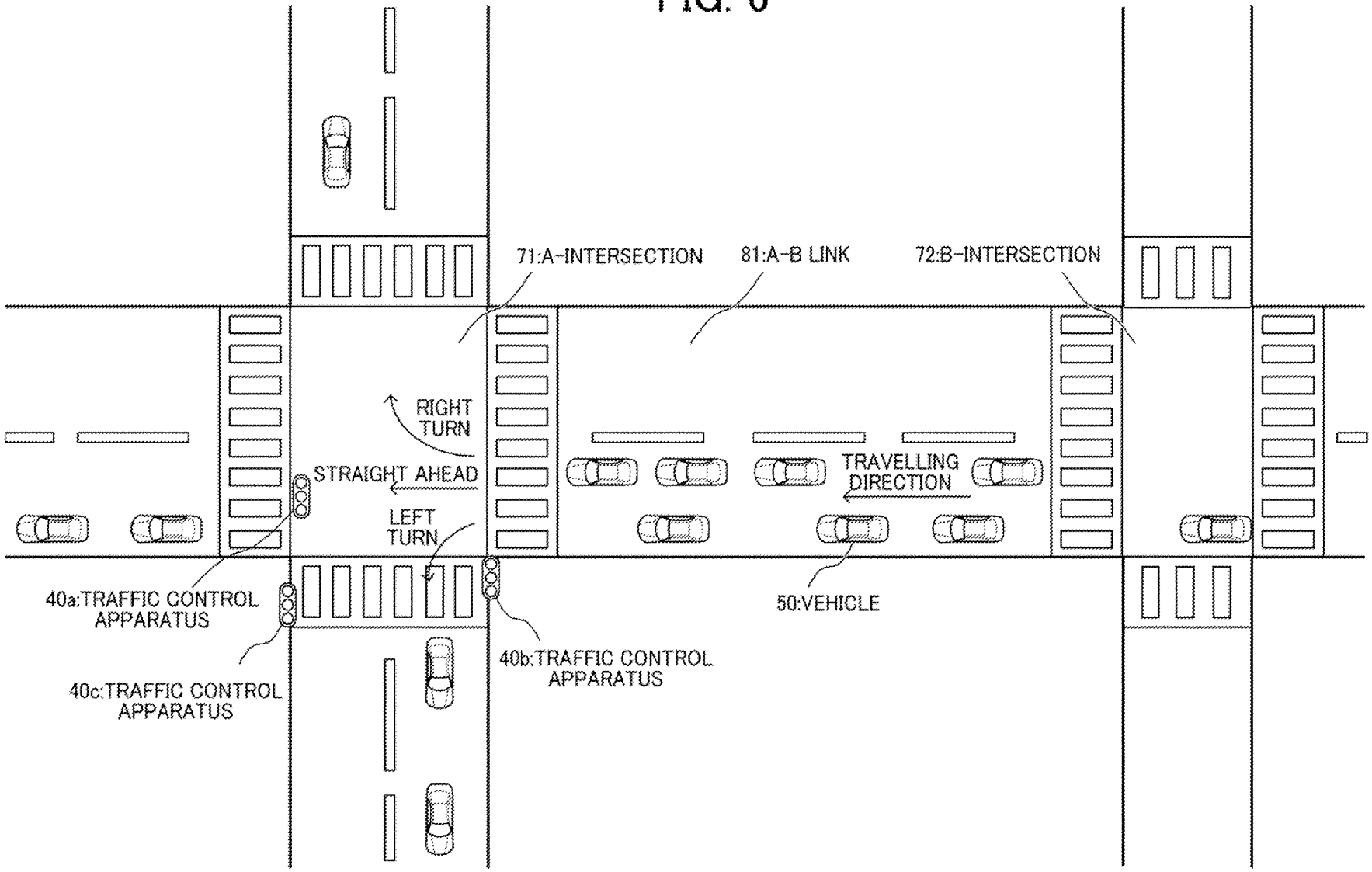
FIG. 6 is a bird's eye view schematically illustrating, as an example, roads on which vehicles according to an embodiment of the present invention travel.

Here, the analytical condition includes, for example, designation indicating link information corresponding to an intersection designated to be an analysis target. This feature is now described with reference to the bird's eye view of FIG. 6 schematically illustrating, as an example, roads on which the vehicles 50 travel. FIG. 6 illustrates, as elements of the roads, an A-intersection 71, a B-intersection 72, an A-B link 81 connecting the two intersection to each other, traffic control apparatuses 40 disposed in correspondence with the roads, and the vehicles 50 traveling on the roads. A traffic control apparatus 40*a* is disposed to perform traffic control with respect to the drivers of the vehicles 50. A traffic control apparatus 40*b* and a traffic control apparatus 40*c* are disposed to perform traffic control with respect to pedestrians walking across a pedestrian crossing. Although further traffic control apparatuses 40 are disposed to correspond to other direction and other pedestrian crossings, such traffic control apparatuses 40 are omitted from FIG. 6.

In this specific example, an assumption is made that the user has a request, "to analyze a traffic status at the A-intersection 71 and in the travelling direction from the B-intersection 72 to the A-intersection 71". Using the input unit 35, the user designates "the travelling direction from the B-intersection 72 to the A-intersection 71 along the A-B link 81 connecting the B-intersection 72 to the A-intersection 71" as an analytical condition. The analytical condition designation unit 312 receives the input as an analytical condition. Note that the analytical condition may additionally include another condition related to a temporal cycle (e.g., 15 minute-intervals) for conducting the analysis. The analytical condition designation unit 312 outputs the received analytical condition to the analysis control unit 313.

The analysis control unit 313 is a component that generates analytical information according to the analytical condition received from the analytical condition designation unit 312, on the basis of the map information 321 and the items of information stored in the positional information database 322. To generate the analytical information, the analysis control unit 313 first identifies, based on the map information 321, a link designated to be the analysis target by the analytical condition received from the analytical condition designation unit 312. For instance, in the example of the above analytical condition, the analysis control unit 313 identifies the travelling direction from the B-intersection 72 to the A-intersection 71 along the A-B link 81, as the analysis target.

Next, the analysis control unit 313 identifies vehicles 50 that passed through the link designated to be the analysis target, based on the movement historical changes of the vehicles 50 identified based on movement historical change information included in the positional information database 322. For instance, in the example of the above analytical condition, the analysis control unit 313 identifies the vehicles 50 that passed through the A-B link 81 in the travelling direction from the B-intersection 72 to the A-intersection 71 to be the analysis target vehicles 50.

Next, the analysis control unit 313 determines a route taken by each of the analysis target vehicles 50, based on the movement historical changes of the vehicles 50. For example, the analysis control unit 313 determines which route each of the vehicles 50 took at the intersection corresponding to the link information (the A-intersection 71 in this example), a straight-ahead route, a left-turn route, or a right-turn route.

Based on the movement historical changes of the vehicles 50, the analysis control unit 313 totalizes link passage times for each of the routes. For example, the analysis control unit 313 totalizes the link passage times (passage times required in passing through the A-B link 81, in this example) of the vehicles 50 that: took the straight-ahead route, those of the vehicles 50 that took the left-turn route, and those of the vehicles 50 that took the right-turn route. The link passage time can be calculated from the point of time when the vehicle 50 entered the link and the point of time when the vehicle left the link. The analysis control unit 313 stores the results of the totalization as un analytical information database 323, in the storage unit 32. An example of the data structure of the analytical information database 323 will be described with reference to FIG. 7.

As illustrated in FIG. 7, the analytical information database 323 includes "time periods" subjected to the totalization. The analytical information database 323 further includes the respective totals of the "link passage times" of the straight-ahead route, the left-turn route, and the right-turn route. The "link passage times" have been determined by the analysis control unit 313 based on the movement historical changes of the vehicles 50. The analysis control unit 313 stores each of these items of information into an associated one of the fields in the analytical information database 323, thereby building and updating the analytical information database 323. If a plurality of items of the link information are received as the analytical condition, the analysis control unit 313 builds and updates an analytical information database 323 for each of the links corresponding to the plurality of items of the link information.

The analysis control unit 313 identifies a cause of traffic congestion based on a disparity between representative values of the respective routes, the representative values being based on the results of totalization. As an example, link passage speeds of the vehicles 50 of the present embodiment are calculated based on the totalized link passage times and the distance between both ends of the link (the distance between both ends of the A-B link 81 in this example) A mode value of the link passage speeds in each route is defined as the representative value, and a disparity between the mode values of the link passage speeds is used as the basis for identifying the cause of traffic congestion.

Figure 8:
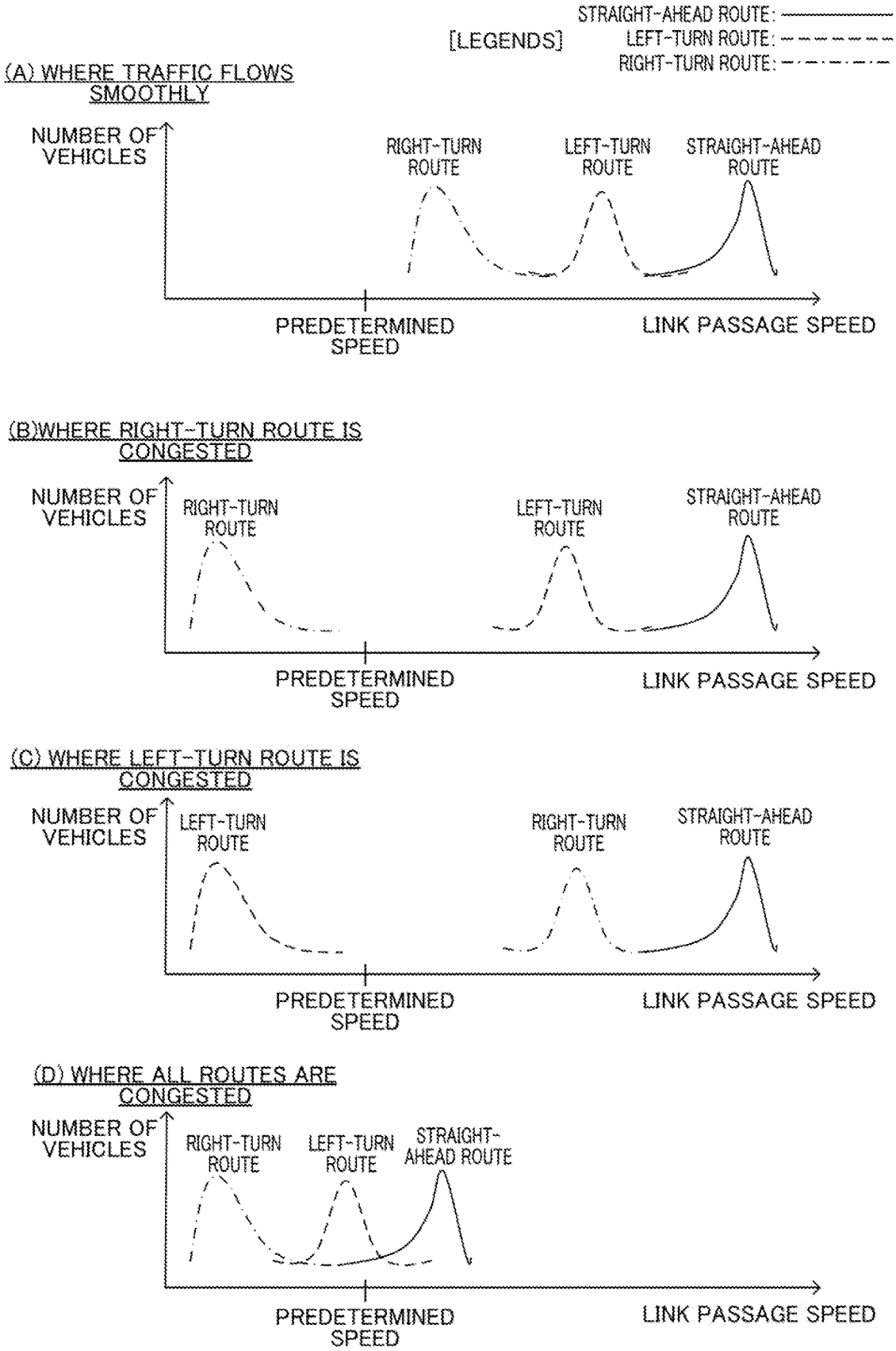
FIG. 8 illustrates, as an example, graphs of results of totalization according to an embodiment of the present invention.

This feature will be described with reference to graphs of FIG. 8, which illustrate examples of the result of totalization. FIG. 8 illustrates four specific examples (A) to (D). Each specific example is represented by the associated graph showing curves plotting the link passage speeds of the vehicles 50 taking the straight-ahead route, the left-turn route, and the right-turn route. As illustrated, in each graph the vertical axis corresponds to the number of vehicles whereas the horizontal axis corresponds to the link passage speeds. In each graph, the link passage speeds of the vehicles 50 that took the straight-ahead route are plotted with a solid curve, the link passage speeds of the vehicles 50 that took the left-turn route are plotted with a dashed curve, and the link passage speeds of the vehicles 50 that, took the right-turn route are plotted with a dash-dot curve. Note that FIG. 8 schematically illustrates the specific examples for the sake of simplification of the description, and does not show the exact link passage speeds.

First, reference is made to (A) in FIG. 8. The link passage speeds in the straight-ahead route, those in the left-turn route, and those in the right-turn route have a mode value (i.e., the peak corresponding to the maximum number of vehicles in the graph) that corresponds to a suitable link passage speed equal to higher than a predetermined speed. In this case, the analysis control unit 313 determines by analysis that, the traffic flows smoothly along the respective routes without traffic congestion. The predetermined speed may be set in advance, or may be appropriately corrected based on statistics of the link passage speeds of the link of interest such that the characteristics of the link of interest are taken into account. In general, among the straight-ahead, left-turn, and right-turn routes, the link passage speed in the straight-ahead route is the highest whereas that in the right-turn route is the lowest. In view of this tendency, different predetermined speeds nay be set for the respective routes.

Next, reference is made to (B) in FIG. 8. Some of the link passage speeds that correspond to the respective mode values of the straight-ahead route, the left-turn route, and the right-torn route (in this example, the link passage speeds in the right-turn route) are lower than the predetermined speed. In this case, the analysis control unit 313 calculates disparities between the mode value of the link passage speeds in the straight-ahead route, the mode value of the link passage speeds in the left-turn route, and the mode value of the link passage speeds in the right-turn route. In this example, the disparity between the mode value of the right-turn route and the mode value of the straight-ahead route and the disparity between the mode value of the right-turn route and the mode value of the left-turn route are relatively large. Accordingly, the analysis control unit 313 determines by analysis that, the traffic flows smoothly along the straight-ahead route and the left-turn route without traffic congestion. On the other hand, the analysis control unit 313 determines by analysis that the right-turn route is in a congested state. Thus, the right-turn route is determined by analysis to be the cause of traffic congestion.

Next, reference is made to (C) in FIG. 8. Some of the link passage speeds that correspond to the respective mode values of the straight-ahead route, the left-turn route, and the right-turn route (in this example, the link passage speeds in the left-turn route) are lower than the predetermined speed. In this case, the analysis control unit 313 calculates disparities between the mode value of the link passage speeds in the straight-ahead route, the mode value of the link passage speeds in the left-turn route, and the mode value of the link passage speeds in the right-turn route. In this example, the disparity between the mode value of the left-turn route and the mode value of the straight-ahead route and the disparity between the mode value of the left-turn route and the mode value of the right-turn route are relatively large. Accordingly, the analysis control unit 313 determines by analysis that the traffic flows smoothly along the straight-ahead route and the right-turn route without traffic congestion. On the other hand, the analysis control unit 313 determines by analysis that the left-turn route is in a congested state. Thus, the left-turn route is determined by analysis to be the cause of traffic congestion.

Next, reference is made to (D) in FIG. 8. Some of the link passage speeds that correspond to the respective mode values of the straight-ahead route, the left-turn route, and the right-turn route (in this example, the link passage speeds in the left-turn route and the right-turn route) are lower than the predetermined speed. In this case, the analysis control unit 313 calculates disparities between the mode value of the link passage speeds in the straight-ahead route, the mode value of the link passage speeds in the left-turn route, and the mode value of the link passage speeds in the right-turn route. In this example, the disparities between the mode values of the respective routes are not large. Accordingly, the analysis control unit 313 determines by analysis that all the routes are in a congested state. Thus, all the routes are determined by analysis to be the cause of traffic congestion.

The analysis control unit 313 outputs the above analytical results to the traffic control instruction unit 314. In response to, for example, an operation by the user, the analysis control unit 313 causes the display unit 34 to display the analytical results und the various items of information stored in the storage unit 32, or transmits the analytical results and the items of information to other devices (not illustrated) communicative via the communication unit 33.

The traffic control instruction unit 314 is a component that transmits a traffic control instruction to the traffic control apparatuses 40, based on the analytical results provided by the analysis control unit 313. For example, when it is determined by analysis that the traffic flows smoothly along the respective routes without traffic congestion as in the case described with reference to (A) of FIG. 8, the traffic control instruction unit 314 does not transmit the traffic control instruction to any of the traffic control apparatuses 40.

Consequently, the traffic control apparatuses 40 switch lights at a preset tiding, and thereby perform traffic control.

For example, when it is determined by analysis that traffic congestion has occurred in the right-turn route as in the case describe with reference to (B) of FIG. 3, the traffic control instruction unit 314 transmits a traffic control instruction to cause the traffic control, apparatus 40 (the traffic control apparatus 40*a* in this case) to extend the duration of a state indicating permission for the vehicles 50 taking the right-turn route to advance (e.g., the duration of an on-state of a green light or an on-state of an arrow light corresponding to right turn). This can facilitate elimination of the congested state of the right-turn route, which is the cause of the traffic congestion.

For example, when it is determined by analysis that traffic congestion has occurred in the left-turn route as in the case described with reference to (C) of FIG. 8, the traffic control instruction unit 314 transmits a traffic control instruction to cause the traffic control apparatus 40 (the traffic control apparatuses 40*c* and 40*b* in this case) to shorten the duration of a state indicating permission for pedestrians to cross the pedestrian crossing on the left-turn route (e.g., the duration of an on-state of a red light). In this way, the so-called "separation of pedestrians from cars" can be attained, thereby facilitating elimination of the congested state of the left-turn route, which is the cause of the traffic congestion.

For example, when it is determined by analysis that traffic congestion has occurred in all the routes as in the case described with reference to (D) of FIG. 3, the traffic control instruction unit 314 transmits a traffic control instruction to cause the traffic control apparatus 40 to extend the duration of a state indicating permission for the vehicles 50 taking the right-turn route to advance. In a case where due to the vehicles 50 taking the right-turn route, the following vehicles 50 taking the straight-ahead route and the left-turn route have caused traffic congestion, this process can facilitate elimination of the congested state. In addition, the traffic control instruction unit 314 transmits a traffic control instruction to cause the traffic control apparatus 40 to shorten the duration of a state indicating permission for pedestrians to cross the pedestrian crossing on the left-turn route. In a case where due to the vehicles 50 taking the left-turn route, the following vehicles 50 taking the straight-ahead route and the right-turn route have caused traffic congestion, this process can facilitate elimination of the congested state.

As can be seen, the analysis device 30 can clarify which of the right-turn route, the left-turn route, and the straight-ahead routes is the cause of traffic congestion. The analysis device 30, which conducts the analysis based on the changes in the positional information of the plurality of vehicles 50, can provide further suitable analytical results, in comparison with the prior art. Further, employing the disparity between the representative values of the respective routes as an explicit criterion enables the analysis to be conducted in a simple manner. In addition, the analysis is conducted not only based on a predetermined absolute criterion (e.g., the predetermined speed) in a unified manner, but also based on a relative criterion, i.e., the disparity between the respective routes. Thus, even in a case where links differ significantly in average passage speed, the routes can be analyzed in a relative manner, with the respective links taken into account.

Further, the analysis device 30 may be configured to show the analytical results to the user. Thus, the user can obtain analytical information that satisfies the desired analytical condition inputted by the user. If the analytical results indicate that traffic congestion has occurred in the right-turn route, the user can take measures for fundamentally eliminating the cause of traffic congestion, such as increasing the length of an existing right-turn lane or providing a new right-turn lane when no right-turn lane exists.

Functional Blocks of Traffic Control Apparatus 40

Figure 9:
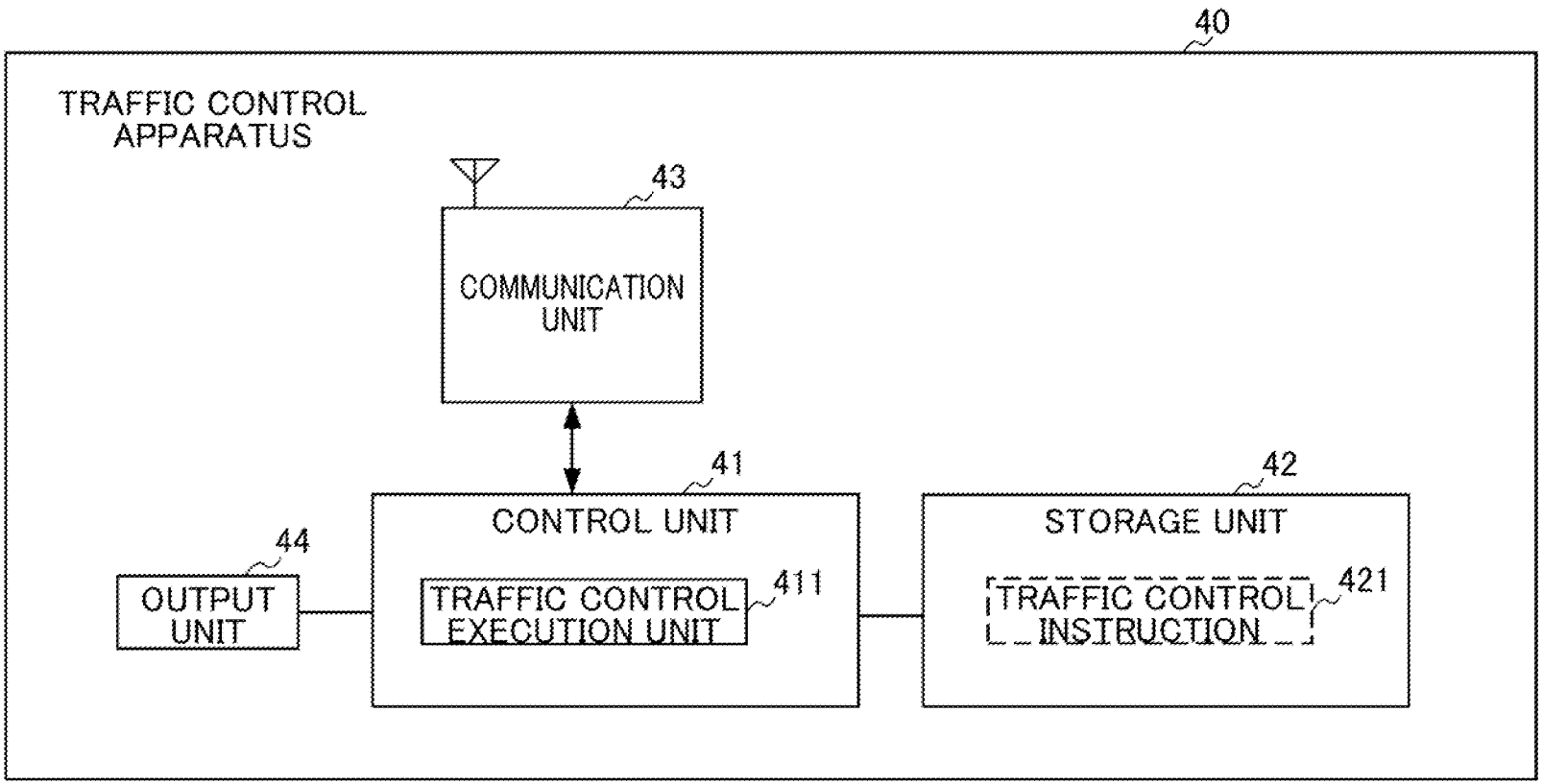
FIG. 9 is a functional block diagram illustrating a functional configuration of a traffic control apparatus according to an embodiment of the present invention.

Next, functional blocks included in the traffic control apparatus 40 will be descried with reference to the block diagram of FIG. 9.

As shown in FIG. 9, the traffic control apparatus 40 includes a control unit 41, a storage unit 42, a communication unit 43, and an output unit 44.

The control unit 41 is configured by an arithmetic processing device, such as a microprocessor, and controls the units forming the traffic control apparatus 40. The details of the control unit 41 will be described later.

The storage unit 42 is configured by, for example, a semiconductor memory, and stores programs, such as a control program called firmware or an operating system. FIG. 9 illustrates, as items of information stored in the storage unit 42, a traffic control instruction 421 that is particularly related to traffic control.

The traffic control instruction 421 constitutes information corresponding to a traffic control instruction received from the analysis device 30. For example, the traffic control instruction 421 includes specifics of traffic control to be performed by a traffic control execution unit 411 (to be described later) and an instruction on timings for the execution. For example, an instruction is included which tells that the so-called green light should be on for a first period of time, and then, should be blinked for a second period of time, and thereafter, the so-called red light should be on for a third period of time.

The communication unit 43 has, for example, a DSP, and adheres to a communication standard such as 3G, LTE, 4G, or Wi-Fi®. The communication unit 43 establishes wireless communication with other devices via the communication network 60. For example, the communication unit 43 is used for reception of the traffic control, instruction transmitted from the analysis device 30. However, data exchangeable between the communication unit 43 and other devices are not particularly restricted. Information other than the foregoing information may be exchanged.

The output unit 44 is a component that performs output for execution of traffic control with respect to the vehicles 50 travelling on a road and pedestrians crossing a pedestrian crossing. For example, the output unit 44 performs output for switching a signal light between an on-state and an off-state, changing a blinking state of the signal light, and emitting a predetermined sound.

The control unit 41 includes the traffic control execution unit 411 as a functional block. The traffic control execution unit 411 is a component that executes the traffic control by controlling the output of the output unit 44. When the traffic control instruction has not been received from the analysis device 30, the traffic control execution unit 411 executes the traffic control by controlling the output of the output unit 44 according to preset specifics or at preset execution timings. On the other hand, when the traffic control instruction has been received from the analysis device 30 and the traffic control instruction 431 has been stored, the traffic control execution unit 411 executes the traffic control by controlling the output of the output unit 44 according to specifics designated by the traffic control instruction 421 or at execution timings designated by the traffic control instruction 421. In this way, the traffic control is executed based on the analytical results provided by the analysis device 30, thereby facilitating elimination of traffic congestion.

Operations of Present Embodiment

Figure 10:
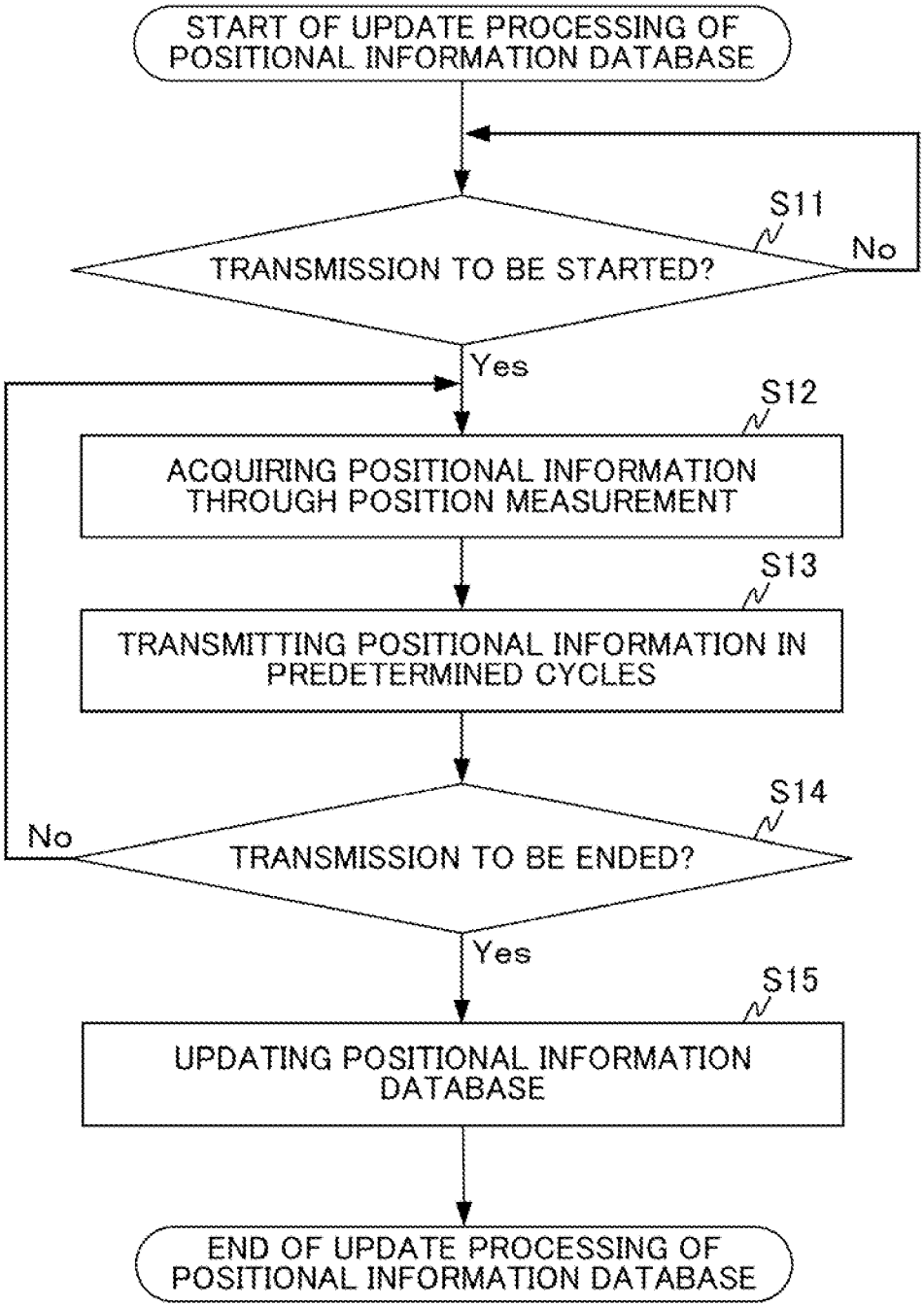
FIG. 10 is a flowchart illustrating a basic operation of update processing for the positional information database according to an embodiment of the present invention.
Figure 11:
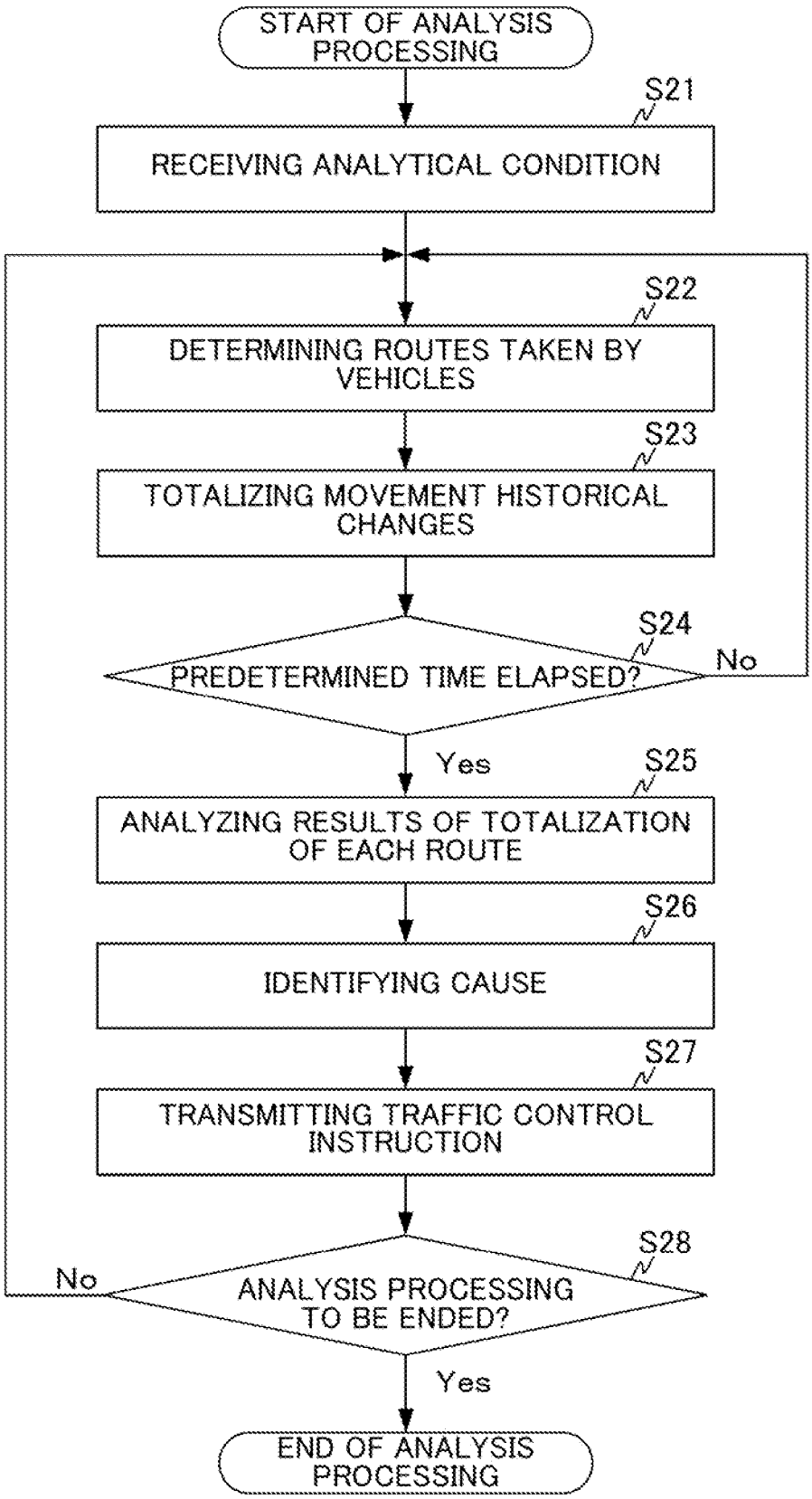
FIG. 11 is a flowchart illustrating a basic operation of analysis processing according to the present invention.

Next, operations according to the present embodiment will be described with reference to flowcharts of FIGS. 10 and 11. Here, the flowchart of FIG. 10 illustrates an operation that is performed mainly by the positional information update unit 311 for collecting the positional information and for updating the positional information database 322. The flowchart of FIG. 11 illustrates an operation performed mainly by the analytical condition designation unit 312, the analysis control unit 313, and the traffic control instruction unit 314 for executing analysis processing.

First, an operation for updating the positional information database 322 based on the positional information collected by the onboard navigation device 10 will be described with reference to FIG. 10. The positional information transmission unit 12 determines whether to start transmission of the positional information (Step S11). Here as described earlier, the transmission is started when the ignition switch of the vehicle 50*a* is turned on. If the ignition switch remains off (if the determination is NO in Step S11), the positional information transmission unit 112 does not start the transmission. If the ignition switch is turned on (if the determination is YES in Step S11), the process proceeds to Step S12.

In Step S12, the sensor unit 14 acquires the positional information by measuring the position of the onboard navigation device 10 (Step S12). The positional information transmission unit 112 receives the positional information from the sensor unit 14, and transmits the received positional information to the analysis device 30 in predetermined cycles, by way of the real-time transmission or the burst transmission (Step S13).

Next, the positional information transmission unit 112 determines whether to end the transmission of the positional information (Step S14). As described earlier, the transmission is ended when the ignition switch of the vehicle 50*a* is turned off. If the ignition switch of the vehicle 50*a* remains on (if the determination is NO in Step S14), the position measurement in Step S12 and the transmission in Step S13 are repeated.

If the ignition switch of the vehicle 50*a* is turned off (if the determination is YES in Step S14), the process proceeds to Step S15.

In Step S15, the positional information update unit 311 of the analysis device 30 updates the positional information database 322 based on the positional information transmitted during the repetition of the Steps S12 and S13 (Step S15). Through the operation described above, the collection of the positional information and the update of the positional information database are achieved.

Next, an operation for updating the positional information database 322 based on the positional information collected by the mobile terminal 20 will be described with reference to FIG. 10. Here, the above description of FIG. 10 suitably applies to this case, while the following changes are made: the positional information transmission unit 112 is replaced with the positional information transmission unit 212; the sensor unit 14 is replaced with the sensor unit 24; in Step S11, the determination is YES "when the start switch of the vehicle 50*b*, such as the ignition switch, is turned on and the vehicle 50*b* is paired with the mobile terminal 20"; and in Step S14, the determination is YES "when the start switch of the vehicle 50*b*, such as the ignition switch, is turned off and the vehicle 50*b* and the mobile terminal 20 become unpaired". Therefore, a redundant description is omitted.

Next, the operation for the analysis processing will be described with reference to the flowchart of FIG. 11. First, the analytical condition designation unit 312 receives, via the input unit 35, an analytical condition from the user (Step S21). The analytical condition designation unit 312 outputs the received analytical condition to the analysis control unit 313.

The analysis control unit 313 determines routes taken by the respective vehicles 50, based on the analytical condition and the map information 321 (Step S22). Based on the determination result in Step S22 and the positional information of the respective vehicles 50 that has been received from the onboard navigation device 10 and the mobile terminal 20 and that is stored in the position information database 322, the analysis control unit 313 updates the analytical information database 323 (Step S23).

The analysis control unit 313 determines whether a predetermined period designated by the analytical condition received in Step S21 (or a preset period) has elapsed since the start of Steps S22 and S23 (Step S24). For example, if the analytical condition designates 15 minutes as the predetermined period (or if the preset period is 15 minutes), the analysis control unit 313 determines whether 15 minutes have elapsed since the start of Steps S22 and S23. If the predetermined period has elapsed (the determination is YES in Step S24), the process proceeds to Step S25. If the predetermined period has not elapsed (the determination is NO in Step S24), the process returns to Step S22, so that the Steps S22 and S23 are repeated.

The analysis control unit 313 analyzes the disparities and the like based on the results of totalization of the respective routes, as described with reference to FIG. 11 (Step S25). Based on the analytical results obtained in Step S25, the analysis control unit 313 identifies a cause of traffic congestion (Step S26).

Based on the cause of traffic congestion identified in Step S26, the traffic control instruction unit 314 generates a traffic control instruction to facilitate elimination of the cause of traffic congestion and transmits the instruction to the traffic control apparatus 40 (Step S27). Upon receiving the traffic control instruction, the traffic control apparatus 40 executes traffic control pursuant to the instruction. In this way, elimination of traffic congestion can be facilitated. Mote that if it is determined by analysis that no traffic congestion has occurred. Step S27 may be omitted.

The analysis control unit 313 determines whether to end the present analysis processing (Step S23). For example, the analysis control unit 313 determines to end the present analytical processing if an end condition designated by the analytical condition received in Step S21 (or a preset end condition) is satisfied. The end condition can be, for example, lapse of a predetermined period since the start of the analysis processing, reception of a new analytical condition, or continuous absence of traffic congestion for a predetermined period. If the end condition is satisfied (if the determination is YES in Step S28), the present analysis processing is ended. If the end condition is not satisfied (if the determination is NO in Step S28), the process returns to Step S22, so that the above-described processing is repeated.

The above-described operations of the present embodiment make it possible to clarify which of the right-turn route, the left-turn route, and the straight-ahead routes is the cause of traffic congestion. Further, elimination of the traffic congestion can be facilitated based on the clarified cause.

Modifications

The embodiment described above is a preferred embodiment of the present invention, but is not intended to limit the scope of the present invention. Embodiments with various modifications are possible without deviating from the spirit of the present invention. For example, the present invention can be embodied with modifications described below.

Modification Related to Analysis

In the embodiment described above, the analysis control unit 313 conducts the analysis to determine the mode values of the link passage speeds in the respective routes as the representative values, and identifies a cause of traffic congestion based on the disparities between the mode values of the link passage speeds. The present Invention is not limited to this. A different value of each route may be defined as the representative value. For example, a mode value of link passage times may be defined as the representative value. Alternatively, instead of the mode value, a median value or a mean value of the link passage speeds or the link passage times may be defined as the representative value. The disparities between the representative values as the mode values, the median values, or the mean values of the link passage speeds or times may be used as the basis of identification of a cause of traffic congestion. This feature makes it possible to use more suitable values as the representative values, according to an analysis target or the like.

In the embodiment described above, the analysis control unit 313 analyzes one link corresponding to the link information designated to be the analysis target; by the analytical condition. The present invention is not limited to this. The analysis control unit 313 may also analyze another link as another analysis target. For example, when a determination made that each of the routes is congested as in the case described with reference to (D) of FIG. 8, a next link where the vehicles taking the straight-ahead route will pass is analyzed as an analysis target. If the next link is congested, it can be determined by analysis that the cause of traffic congestion is the next link (in other words, the straight-ahead route toward the next link is the cause of traffic congestion). On the other hand, if the next link is not congested, it can be determined by analysis that due to the vehicles 50 taking the left-turn route or those taking the right-turn route, the road is congested with the following vehicles 50 that take the straight-ahead route.

Other Modifications

As another modification, the onboard navigation device 10 and the mobile terminal 20 may be implemented by other devices not having the route guidance function. That, is, the route guidance function of the onboard navigation device 10 and the mobile terminal 20 is not an essential element. In this case, the analysis device 30 may further have the route guidance function, and may perform the route guidance function by communicating with the onboard navigation device 10 and the mobile terminal 20.

Another modification relates to the analysis device 30. In the above embodiment, the analysis device 30 has been described to be implemented by, for example, one server device. However, a distributed processing system may be adopted in which the functions of the analysis device 30 are appropriately distributed to a plurality of server devices. Alternatively, the functions of the analysis device 30 may be implemented by, for example, a virtual server function in a cloud. Further, the traffic control apparatus 40 may have other functions, in addition to the function as a traffic light turning on and off the signal lights. For example, the traffic control apparatus 40 may have a function of transmitting information for traffic control directly to the onboard navigation device 10 and the mobile terminal 20. That is, the functional structures illustrated in FIGS. 2 to 4 and 9 are mere examples, and are not intended to limit the functional structures of the embodiment. Thus, it is suitable that the devices and the units have, as a whole, functions of executing the series of processing related to the information analysis of the present invention. Functional blocks for use to attain the information analysis are not limited to the examples illustrated in FIGS. 2 to 4 and 9.

Regarding Hardware and Software

It should be noted that each of the respective devices included in the above-mentioned analysis system can be implemented by hardware, software, or a combination thereof. In addition, the analysis method performed by way of the cooperation of the respective devices included in the above-mentioned navigation system can also be implemented by hardware, software, or a combination of these. Herein, being implemented by software indicates being implemented by a computer reading and executing n program.

The program can be stored using various types of non-transitory computer readable media, and supplied to the computer. Non-transitory computer readable medium includes various types of tangible storage media. Examples of non-transitory computer readable media include magnetic recording media (e.g., flexible disk, magnetic tape, hard disk drive), magneto-optical recording media (e.g., magneto-optical disk), CD-ROM (Read Only Memory), CD-R, CD-R/W, and semiconductor memory (e.g., mask POM, PROM (programmable ROM), EPROM (Erasable PROM), flash ROM, RAM (random access memory)). In addition, the program may be supplied to the computer by way of various types of transitory computer readable media. Examples of transitory computer readable media include electrical signals, optical signals, and electromagnetic waves. Transitory computer readable media can supply programs to the computer via wired communication paths such as electric wires and optical fiber, or wireless communication paths.

EXPLANATION OF REFERENCE NUMERALS

1: Analysis System
10: Onboard Navigation Device
11, 21, 31, 41: Control Unit
111, 211: Route Guidance Unit
112, 212: Positional Information Transmission Unit
12, 22, 32, 42: Storage Unit
121, 221: Positional Information
122, 222: Movable Body Identification Information
13, 23, 33, 43: Communication Unit
14, 24: Sensor Unit
15, 25, 34: Display Unit
16, 26, 35: Input Unit
20: Mobile Terminal
27: Near Field Communication Unit
30: Analysis Device
311: Positional Information Update Unit
312: Analytical Condition Designation Unit
313: Analysis Control Unit
314: Traffic Control Instruction Unit

321: Map Information
322: Positional Information Database
323: Analytical Information Database
40: Traffic Control Apparatus
44: Output Unit.
411: Traffic Control Execution Unit
421: Traffic Control Instruction
50*a*, 50*b*: Vehicle
60: Communication Network

The invention claimed is:

1. An analysis device comprising:

a reception unit that receives changes in positional information of a plurality of movable bodies;

a map information storage unit that stores information of roads where the plurality of movable bodies are allowed to pass, together with link information of links including intersections;

a link designation unit that receives designation that indicates the link information designated to be an analysis target; and a control unit that determines routes taken by the plurality of movable bodies that have passed through the link corresponding to the designated link information, totalizing link passage times for each of the routes, and identifying a cause of traffic congestion from a disparity between representative values of the respective routes based on results of totalization.

2. The analysis device according to claim 1, wherein the representative value is a mode value, a median value, or a mean value of the link passage times or of link passage speeds calculated based on the link passage times and a distance between both ends of the link corresponding to the link information.

3. The analysis device according to claim 1, further comprising:

a traffic control instruction unit that instructs an external traffic control apparatus to switch control such that the cause of traffic congestion identified by the control unit is eliminated.

4. An analysis method to be performed by a computer, the analysis method comprising:

a reception step comprising receiving changes in positional information of a plurality of movable bodies;

a map information storage step comprising storing information of roads where the plurality of movable bodies are allowed to pass, together with link information of links including intersections;

a link designation step comprising receiving designation that indicates the link information designated to be an analysis target; and a control step comprising determining routes taken by the plurality of movable bodies that have passed through the link corresponding to the designated link information, totalizing link passage times for each of the routes, and identifying a cause of traffic congestion from a disparity between representative values of the respective routes based on results of totalization.

* * * * *